US005334089A

United States Patent [19]

Beck et al.

[11] Patent Number: 5,334,089

[45] Date of Patent: Aug. 2, 1994

[54] FUME HOOD WITH ADJUSTABLE BAFFLE ASSEMBLY

[75] Inventors: Marshall K. Beck; John M. Bastian, both of Manitowoc, Wis.

[73] Assignee: Fisher Hamilton Scientific Inc., Two Rivers, Wis.

[21] Appl. No.: 947,783

[22] Filed: Sep. 18, 1992

[51] Int. Cl.[5] ..... F24F 7/00

[52] U.S. Cl. ..... 454/62; 454/347

[58] Field of Search ..... 454/61, 62, 49, 347

[56] References Cited

U.S. PATENT DOCUMENTS

| | | | |
|---|---|---|---|
| 2,704,505 | 3/1955 | Morrison | 98/115 |
| 3,022,718 | 2/1962 | Thompson | 454/62 |
| 3,217,630 | 11/1965 | Katzfey et al. | 98/115 |
| 3,218,953 | 11/1965 | Grow et al. | 98/115 |
| 3,747,504 | 7/1973 | Turko et al. | 98/115 |
| 4,177,717 | 12/1979 | Grow et al. | 98/115 |
| 4,785,722 | 11/1988 | Dollhopf et al. | 454/62 |

*Primary Examiner*—William E. Wayner

*Attorney, Agent, or Firm*—Tilton, Fallon, Lungmus & Chestnut

[57] ABSTRACT

A fume hood with an adjustable baffle system includes a housing with a chamber and a baffle system disposed in the chamber. The baffle system includes a plurality of baffle plates and a plurality of support brackets for releasably securing the baffle plates in substantially end-to-end relation in the chamber. The support brackets allow adjustment of at least one plate to vary the gap or distance between the plate and an adjacent plate.

8 Claims, 1 Drawing Sheet

FUME HOOD WITH ADJUSTABLE BAFFLE ASSEMBLY

BACKGROUND OF THE INVENTION

1. Field of the Invention

The present invention relates to a fume hood with an adjustable baffle assembly, and more particularly to a fume hood with a plurality of baffle plates releasably secured to the housing of the fume hood with securing brackets which allow adjusting of at least one baffle plate to vary the gap or distance between it and another plate.

2. Description of the Prior Art

Typically, fume hoods must exhaust both lighter than air and heavier than air fumes. To exhaust lighter than air fumes, a fume hood should include a baffle system which allows the blower of the fume hood to pull air from an upper portion of the hood chamber. To exhaust heavier than air fumes, the baffle system should allow the blower to pull air from a bottom portion of the hood chamber.

The prior art includes a variety of fume hoods with baffle systems for evacuating the hood chamber of fumes. These prior fume hoods use complicated housing and baffle arrangements with close tolerance components. Producing these prior fume hoods requires accurate and expensive fabrication procedures as well as complicated and time-consuming assembly processes.

The fume hood of the present invention provides a simple baffle structure, including baffle plates releasably secured to the fume hood's housing along the rear wall of the chamber defined by the housing. It includes support structures which allow quick assembly and adjustment of at least one baffle plate to a plurality of positions so that the operator may direct the pull of the fume hood blower to various locations of the hood's chamber. These support structures also allow easy removal of the baffle plates for cleaning or repair. The baffle assembly is a simple arrangement which provides precise and reliable performance and minimizes the expense of manufacture and assembly.

SUMMARY OF THE INVENTION

In accordance with one embodiment of this invention, a fume hood includes a housing which defines a chamber and a front access opening for the chamber. A baffle assembly disposed in the chamber cooperates with a blower to evacuate the chamber of fumes. This assembly lies proximate the rear wall of the chamber and along with the rear wall defines a passageway along the rear wall to an outlet at the top of the fume hood housing. A conduit connects the outlet to the blower.

The baffle assembly includes a plurality of baffle plates disposed in end-to-end, substantially upright, relation. A plurality of brackets fixedly secured with conventional securing means, e.g. screws or nuts and bolts, to the housing releasably secure the plates to the housing. The brackets disposed at opposite ends of the baffle assembly include recess for receiving edge portions of the end plates. Those which support adjacent baffle plates include one or more recesses for receiving and releasably securing a top edge portion of one plate and recesses for receiving and releasably securing a bottom edge portion of an adjacent plate.

BRIEF DESCRIPTION OF THE DRAWINGS

For a more complete understanding of the present invention, one should now refer to the embodiment illustrated in greater detail in the accompanying drawings and described below as an example of the invention. In the drawings.

While the following describes the invention in connection with one embodiment, one should understand that the invention is not limited to this embodiment. Furthermore, one should understand that the drawings are not to scale and that graphic symbols, diagrammatic representations, and fragmentary views may, in part, illustrate the embodiment. In certain instances, the disclosure may not include details which are not necessary for the understanding of the present invention.

DETAILED DESCRIPTION OF THE DRAWINGS

Figure 1:
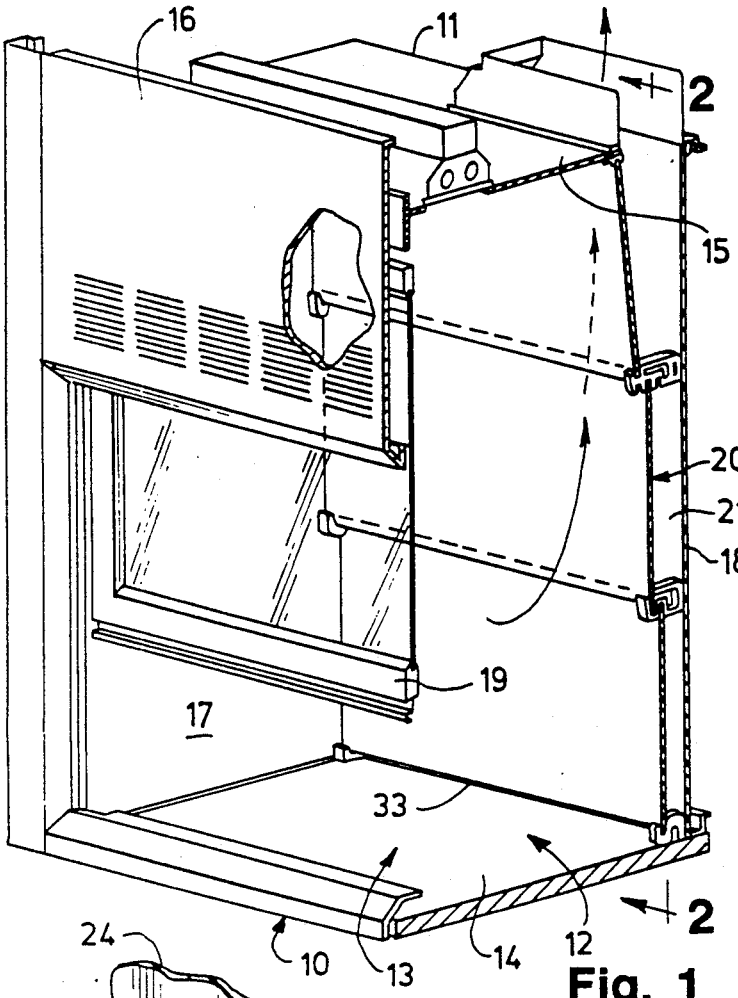
FIG. 1 is a perspective view of the fume hood of the present invention with a portion of the fume hood cut away.

In the illustration given and with reference to FIG. 1, the numeral 10 designates the fume hood of the present invention. This fume hood generally includes a housing 11 and a blower (not shown). The housing defines a chamber 12 with a front opening 13 and comprises a base 14, a top panel 15, a front panel 16, side panels 17, and a rear panel 18. A sash 19, slidably mounted to the housing 11 opens and closes the opening 13. The housing 11 and the various components described below are members made out of metal, hard plastic, or any other material of sufficient strength, rigidity and corrosion resistance.

A baffle assembly 20 disposed in the chamber 12 cooperates with the rear panel 18 and the side panels 17 to define a passageway 21 through which the blower pulls fumes out of the chamber 12 and into an outlet 21*a*. This assembly 20 includes a lower or first baffle plate 22, a middle baffle plate 23, and a top baffle plate 24. The plates 22–24 are made of cement board or a polyester material. (Alternatively, they may be made of polyvinyl chloride, polypropylene, or any other suitable material.) They lie in substantially end-to-end relation with each other and in face-to-face relation with the rear panel 18.

A row of brackets 25 and a row of brackets 26 releasably secure the plate 22 to the panel 18. The brackets 25 lie on top of the base 14; and suitable securing means (e.g. screws) fixedly secure them to the panel 18. These brackets define a recess 27 which receives a bottom edge portion of the plate 22. The width of this recess 27 is slightly greater than the thickness of the plate 22 to allow easy insertion of the plate into the recess. (The recesses identified below have substantially the same width as the recess 27 and the other plates, plates 23 and 24, have the same thickness as the plate 22.)

The brackets 26 lie in a row, a predetermined distance above the base 14, fixedly secured to the panel 18. Each of these brackets 26 includes a recess 28 which receives a top edge portion of the plate 22. The height of the plate 22 between the brackets 25 and 26 is less than the distance between the bottom of the recess 27 and the bottom of the recess 28. This feature allows an operator to remove the plate 22 by lifting the plate 22 out of the recesses 27 and pulling it away from the brackets 25 and then out of the recesses 28.

Figure 2:
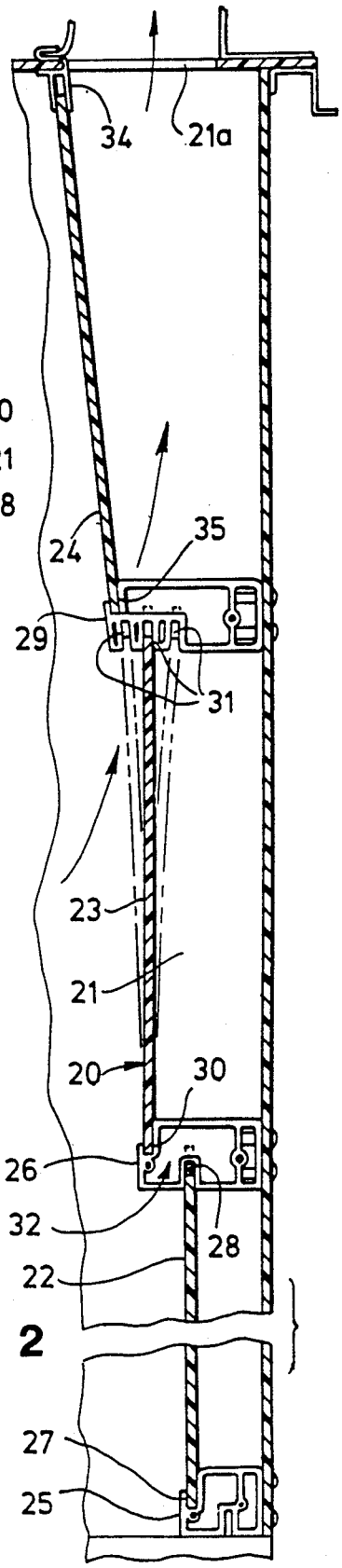
FIG. 2 is a sectional view taken along line 2—2 in FIG. 1.

The brackets 26 also support the plate 23 and cooperate with a row of brackets 29 to releasably secure the plate 23 to the panel 18. Each bracket 26 defines a recess 30 which receives a bottom edge portion of the plate 23. As explained above, this recess 30 has a width greater than the thickness of the plate 23 to allow easy insertion of the plate 23. This recess also serves as a pivot point for the plate 23 and allows the plate 23 to tilt forwardly or rearwardly as shown in FIG. 2.

The brackets 29 lie in a row fixedly secured to the panel 18, a predetermined distance above the base 14. Each bracket 29 includes a plurality of recesses 31 which receive a top edge portion of the plate 23. The recesses 31 allow adjustment of the plate 23 to the various positions shown in solid and phantom lines in FIG. 2.

In the most forward position of the plate 23, a gap between the top edge of the plate 23 and the bottom edge of the plate 24 closes; and fumes from the chamber 12 move into the passageway 21 through a gap 32 between the plates 22 and 23 or through a gap 33 (See FIG. 1) between the plate 22 and the base 14. In the most rearward position, the gap between the plates 23 and 24 is open and fumes may enter into the passageway 21 through this gap.

The brackets 29 also support the top plate 24 and cooperate with a row of clips or brackets 34 to releasably secure the plate 24 to the rear panel 18 and the top panel 15. Each bracket 29 has a recess 35 which receives a lower edge portion of the plate 24; and the bracket 34 defines a recess which receives an upper edge portion of the plate 24. As explained above, the plate 24 does not fit closely in the recesses which receive it; and the play between it and the brackets allows an operator to remove the plate 24 from the position shown.

The brackets described above allow easy assembly of all the baffle plates. They also allow quick and easy removal or disassembly of the plates for cleaning or repair. They are made of polyester or any material that resists chemical action and has sufficient strength and rigidity.

Figure 3:
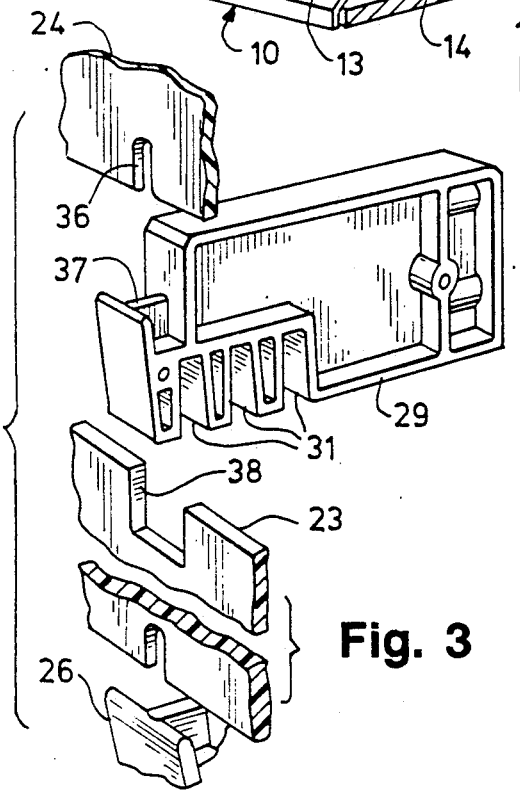
FIG. 3 is a partial perspective and exploded view of one of the bracket and baffle connection shown in FIG. 2.

As shown in FIG. 3, each of the plates 22–24 has a notch 36 for each bracket that supports it. Each notch 36 cooperates with a corresponding tab position 37 which extends across a recess (e.g. recesses 27, 30 or 35) to prevent lateral movement of a plate. In addition, each of the plates 22 and 23 has a notch 38 for each bracket that receives its upper edge portion to allow the plate to extend above the bottom of the recesses (e.g. recesses 31) and have adjacent edge portions lie in overlapping relation.

While the applicant has shown one embodiment of the present invention, one will understand, of course, that the invention is not limited to this embodiment, as those skilled in the art to which the invention pertains may make modifications and other embodiments of the principles of the invention, particularly upon considering the foregoing teachings. The applicant, therefore, by the appended claims, intends to cover any modifications and other embodiments which incorporate those features which constitute the essential features of this invention.

What is claimed is:

1. In a fume hood with a housing defining a chamber with a front opening, a baffle assembly disposed in the chamber, said baffle assembly comprising: a plurality of baffle plate members disposed in substantially end-to-end relation; and baffle support means fixedly secured to the housing for receiving bottom edge portions of the baffle plate members and supporting the baffle plate members in substantially upright positions, said support means including retaining means for releasably securing the top edge portion of one of the baffle plate members at a plurality of predetermined positions to vary the distance between that one baffle plate member and an adjacent plate member.

2. The fume hood of claim 1, wherein the baffle support means includes a first row of brackets for supporting a first baffle plate member, each of said brackets of said first row defining a recess for receiving a bottom edge portion of the first baffle plate member.

3. The fume hood of claim 2, wherein the baffle support means includes a second row of brackets, each of said brackets of said second row defining at least one recess for releasably securing a top edge portion of the first baffle plate member and another recess for receiving a bottom edge portion of an adjacent, second baffle plate member.

4. The fume hood of claim 3, wherein the baffle support means includes a third row of brackets, each of said brackets of said third row defining a plurality of recesses for releasably securing a top edge portion of the second baffle plate member at a plurality of predetermined positions, and a recess for receiving a bottom edge portion of an adjacent, third baffle plate member.

5. The fume hood of claim 1, wherein the baffle plate members lie in substantially face-to-face relation with a rear wall of the chamber.

6. In a fume hood with a housing defining a chamber with a front opening, a baffle assembly disposed in the chamber, said baffle assembly comprising: a baffle plate member disposed in the chamber; first baffle support means fixedly secured to the housing for supporting the baffle plate member; and second baffle support means fixedly secured to the housing a predetermined distance from the first baffle support means for releasably securing an edge portion of the baffle plate member at a plurality of predetermined positions, said second baffle support means including at least one retaining bracket which defines a plurality of recesses for receiving the edge portion of the baffle plate member.

7. The fume hood of claim 6, wherein the first baffle support means includes a plurality of support brackets, each bracket being a plate-like member and defining a recess for receiving a bottom edge portion of the baffle plate member.

8. The fume hood of claim 6, wherein the second baffle support means includes a plurality of retaining brackets.

* * * * *